US010221619B2

(12) United States Patent
Chen

(10) Patent No.: US 10,221,619 B2
(45) Date of Patent: Mar. 5, 2019

(54) LIFTING DEVICE OF CORDLESS COVERING

(71) Applicant: NIEN MADE ENTERPRISE CO., LTD., Taichung (TW)

(72) Inventor: Lin Chen, Taichung (CN)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/601,715

(22) Filed: Jan. 21, 2015

(65) Prior Publication Data

US 2016/0208549 A1 Jul. 21, 2016

(51) Int. Cl.
*E06B 9/262* (2006.01)
*E06B 9/322* (2006.01)

(52) U.S. Cl.
CPC ..... *E06B 9/322* (2013.01); *E06B 2009/2627* (2013.01); *E06B 2009/3222* (2013.01)

(58) Field of Classification Search
CPC ..... E06B 2009/3222; E06B 2009/2627; E06B 9/322
See application file for complete search history.

(56) References Cited

U.S. PATENT DOCUMENTS 2,420,301 A 5/1947 Cusumano
5,996,670 A * 12/1999 Igarashi ..... E06B 9/17007 160/133
6,283,192 B1 9/2001 Toti
7,040,374 B2 * 5/2006 Wen ..... E06B 9/304 160/168.1 P
7,228,797 B1 6/2007 Hillman et al.
7,398,815 B2 * 7/2008 Liang ..... E06B 9/262 160/170
7,487,817 B2 * 2/2009 Liang ..... E06B 9/32 160/170
7,984,745 B2 * 7/2011 Wen ..... E06B 9/322 160/170
8,757,239 B2 6/2014 Colson et al.
9,121,221 B2 * 9/2015 Cheng ..... E06B 9/322
(Continued)

FOREIGN PATENT DOCUMENTS

CN 201024877 Y 2/2008
CN 203789657 U 8/2014
(Continued)

*Primary Examiner* — Katherine W Mitchell
*Assistant Examiner* — Abe Massad
(74) *Attorney, Agent, or Firm* — Lynette Wylie; Apex Juris, PLLC.

(57) ABSTRACT

A lifting device of a cordless covering includes a cord reel, a car, a driving module, a connecting cord, and a lifting cord. The cord reel has a cone section, and is pivoted on a headrail for free rotation. The car is received in the headrail for reciprocation. The driving module is received in the headrail to drive the cord reel to rotate in a predetermined direction. The connecting cord has opposite ends connected to the car and the cord reel, wherein the connecting cord is reeled in and out of the cone section of the cord reel when the cord reel rotates in different directions. The lifting cord runs around the car, and then extends out of the headrail to be fastened to a bottom rail. The cord reel and the driving module are helpful to precisely stop and bottom rail at any desired position.

4 Claims, 5 Drawing Sheets

(56) References Cited

U.S. PATENT DOCUMENTS

| | | | | |
|---|---|---|---|---|
| 9,309,716 | B2 * | 4/2016 | Chen | E06B 9/322 |
| 2004/0177933 | A1 | 9/2004 | Hillman et al. | |
| 2007/0119547 | A1 * | 5/2007 | Liang | E06B 9/32 160/170 |
| 2007/0125505 | A1 | 6/2007 | Liang | |
| 2007/0272364 | A1 | 11/2007 | Liang | |
| 2009/0159219 | A1 | 6/2009 | Wen et al. | |
| 2011/0315329 | A1 * | 12/2011 | Hong | E06B 9/262 160/340 |
| 2013/0112353 | A1 * | 5/2013 | Sengelaub | E06B 9/262 160/84.02 |
| 2014/0224431 | A1 | 8/2014 | Lin | |

FOREIGN PATENT DOCUMENTS

| | | | |
|---|---|---|---|
| JP | 1978126478 | A | 11/1978 |
| TW | M454450 | U | 6/2013 |

* cited by examiner

LIFTING DEVICE OF CORDLESS COVERING

BACKGROUND OF THE INVENTION

1. Technical Field

The present invention relates generally to a covering, and more particularly to a lifting device of a cordless covering.

2. Description of Related Art

There are various coverings for windows and doors, some of which are cordless coverings. The cordless covering has no cord for user to pull to lift a covering material. Since no cord is left on the cordless covering, it may avoid the problem of strangling kids, and the covering looks fancier without the cord.

A conventional cordless covering is provided with an automatic lifting device to lift or lower a bottom rail of the covering material. The covering material could be slats, a cellular shade, a pleated blind, or other shades and blinds. No matter what kind of the covering materials is used, the covering is provided with lifting cords extending out of a headrail, passing through the covering material, and then fastened to the bottom rail. The lifting cords are connected to the automatic lifting device in the headrail. The automatic lifting device may reel in or out the lifting cords to lift or lower the bottom rail so as to lift or lower the covering material.

However, it would get heavier while the bottom rail and the covering material are being lifted, but the conventional automatic lifting device only provides a constant lifting force. Therefore, the user has to push the bottom rail harder to assist the automatic lifting device. The other problem is that the bottom rail will never stop at the desired position, usually at a lower than desired position, because the weight of the bottom rail and the covering material will move the bottom rail downwards.

Take a cellular covering for example, the cellular shade has many chambers therein which make the cellular shade compressible. However, the cellular shade generates an internal shrinking force when it is extended. For this reason, some manufacturers provide the bottom rail some extra weights to offset the shrinking force of the cellular shade. But the heavy bottom rail makes the product heavier, the user have to push the bottom rail harder to lift the bottom rail and the cellular shade, and it still has the problem that the bottom rail can not stop at the desired position, but lower than that.

BRIEF SUMMARY OF THE INVENTION

In view of the above, the primary objective of the present invention is to provide a lifting device of a cordless covering, which may reduce the user's power for lifting the covering, and precisely stop the bottom rail at any desired position.

The present invention provides a lifting device of a cordless covering, wherein the cordless covering includes a headrail, a bottom rail, and a covering material between the headrail and the bottom rail. The lifting device includes a cord reel, a car, a driving module, a connecting cord, and a lifting cord. The cord reel has a cone section, and is pivoted on the headrail to rotate in a first direction and in a second direction. A diameter of the cone section decreases from an end to an opposite end. The car is received in the headrail to be moved toward or away from the cord reel. The driving module is received in the headrail to drive the cord reel to rotate in the first direction. The connecting cord has opposite ends connected to the car and the cord reel, wherein the connecting cord is reeled in the cone section of the cord reel when the cord reel rotates in the first direction, and the connecting cord is reeled out from the cone section of the cord reel when the cord reel rotates in the second direction. The lifting cord runs around the car, and then extends out of the headrail to be fastened to the bottom rail. The car moves away from the cord reel to drive the cord reel to rotate in the second direction while the bottom rail is moved away from the headrail.

In an embodiment, the driving module includes a first reel, a second reel, and a mainspring; the first reel is provided with a first gear, the second reel is provided with a second gear, to be meshed with the first gear of the first reel, and the cord reel is provided with a third gear to be meshed with the second gear of the second reel; the mainspring has opposite ends connected to the first reel and the second reel respectively, whereby the mainspring is wound around the first reel or the second reel when the first reel and the second reel rotate in the first direction or in the second direction.

In an embodiment, the lifting device further includes a wheel set received in the headrail, wherein the wheel set includes a shaft for the lifting cord to run around.

In an embodiment, the car is provided with a shaft for the lifting cord to run around.

In an embodiment, the lifting cord has opposite ends fastened to the car, and the bottom rail respectively.

In an embodiment, the lifting cord has an end fastened to the wheel set, and then extends out of the headrail to be fastened to the bottom rail.

Whereby, the cone-like cord reel and the driving module are helpful to precisely stop the bottom rail at any desired position.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
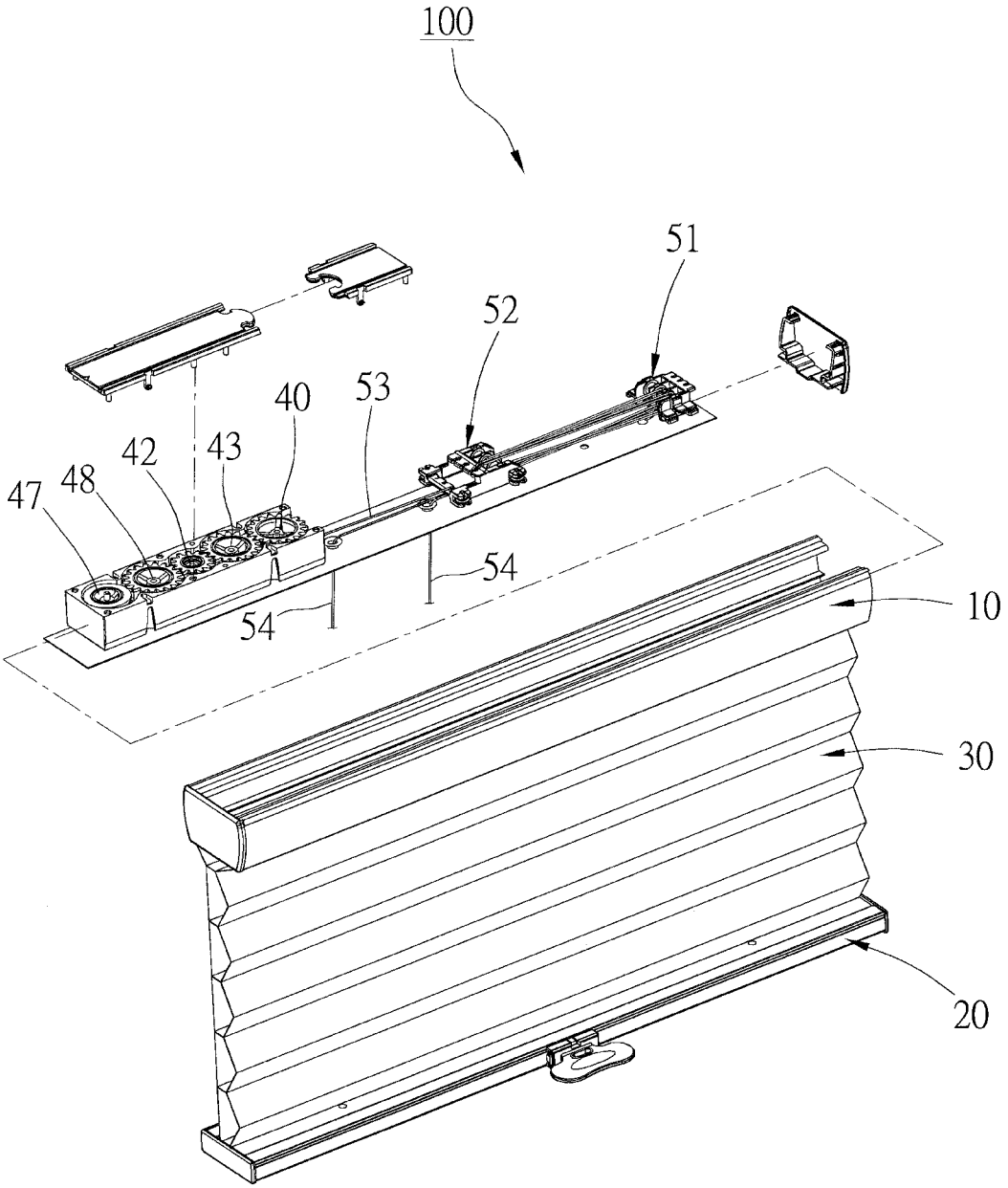
FIG. 1 is an exploded view of a preferred embodiment of the present invention.
Figure 2:
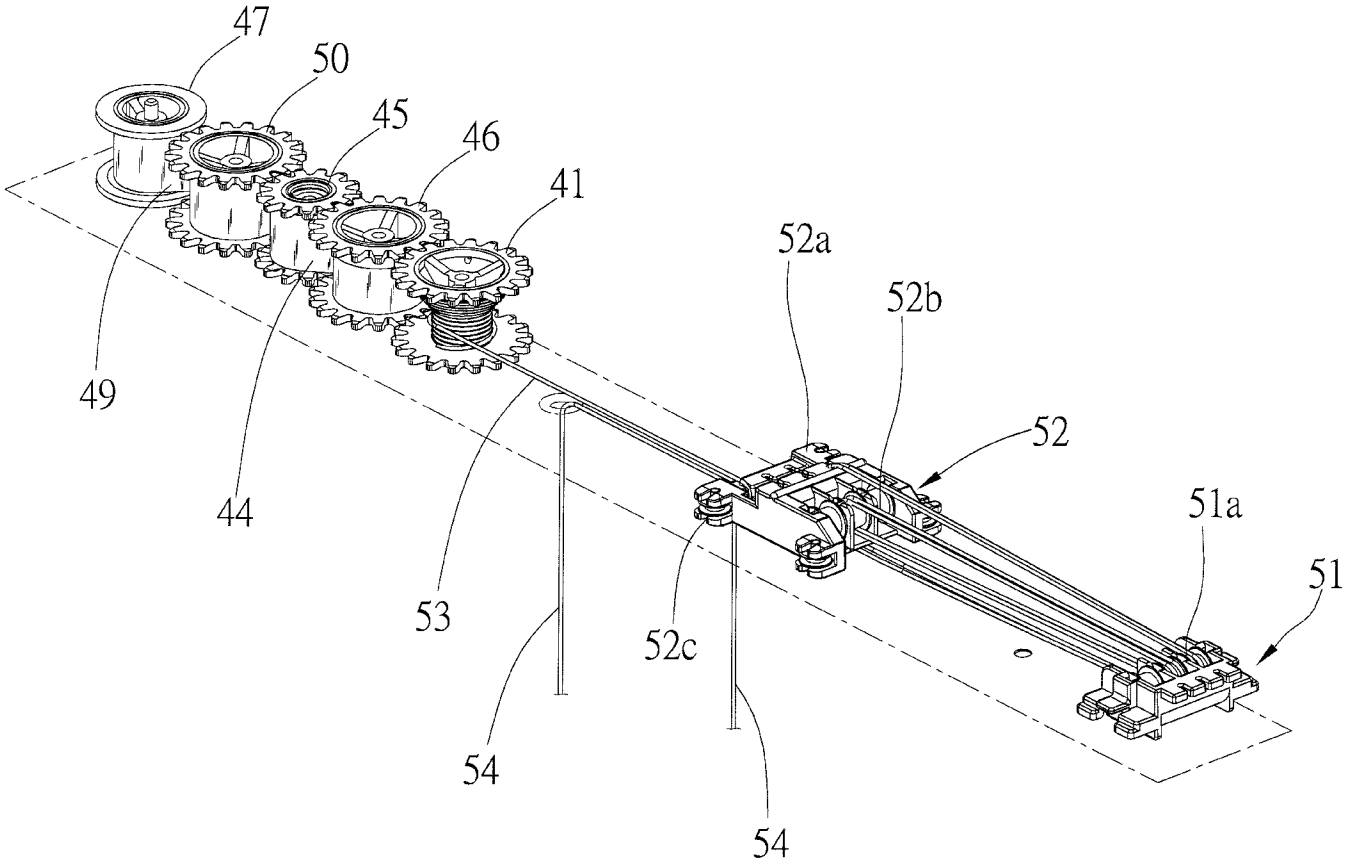
FIG. 2 is a perspective view of the lifting device of the preferred embodiment of the present invention.
Figure 3:
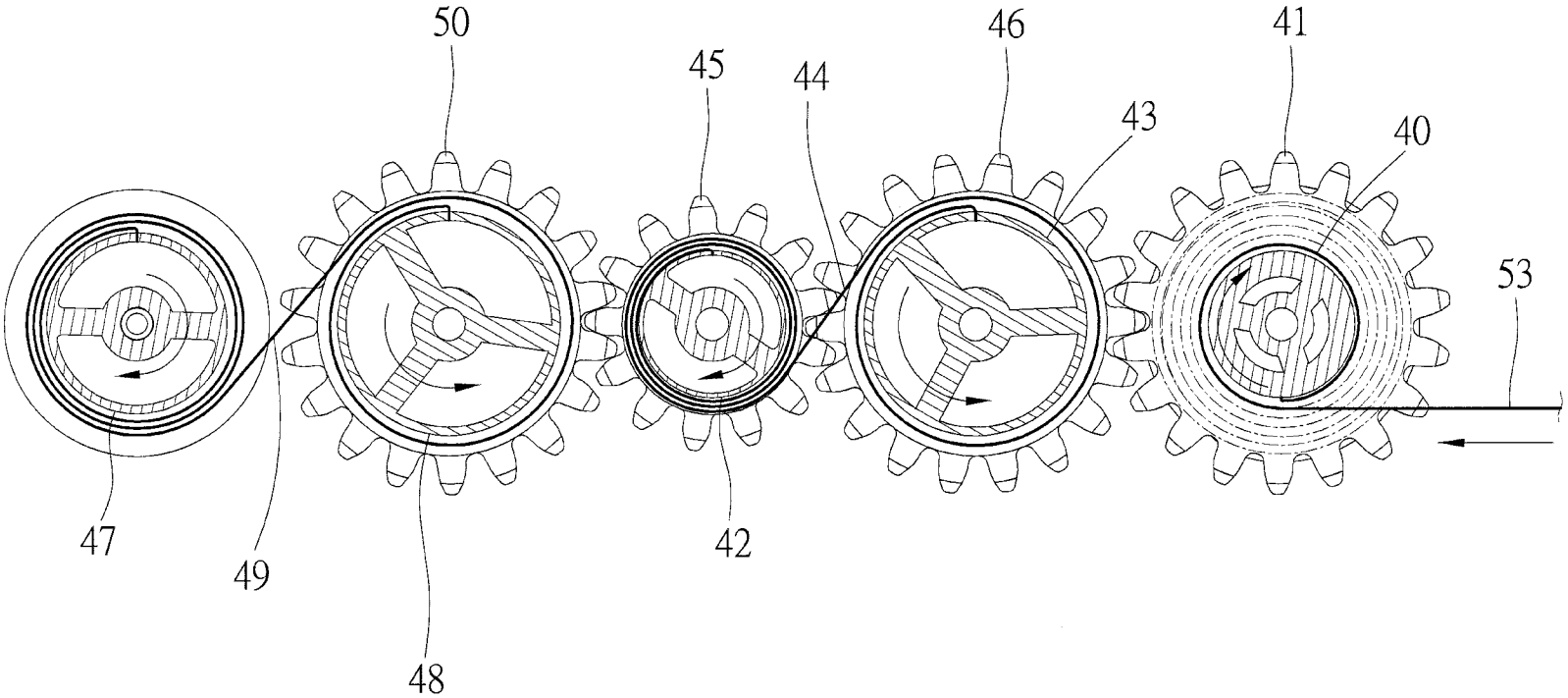
FIG. 3 is a sectional view of a part of the lifting device of the preferred embodiment of the present invention.

As shown in FIG. 1 to FIG. 3, a cordless covering 100 of the preferred embodiment of the present invention includes a headrail 10, a bottom rail 20, and a covering material between the headrail 10 and the bottom rail 20. In the present embodiment, the covering material is a cellular shade 30.

However, the covering material could be a blanket or slats in other embodiments. The cordless covering 100 is further provided with a lifting device received in the headrail 10, including a cord reel 40, a driving module, an auxiliary driving module, a wheel set 51, a car 52, a connecting cord 53, and two lifting cords 54.

The cord reel 40, the driving module and the auxiliary driving device are preinstalled at a side of the headrail 10 while the wheel set 51 and the car 52 are at the other side. The cord reel 40 is a cone-like member vertically pivoted on the headrail 10 with a narrow end at bottom. The cord reel 40 is controllable to rotate in a first direction (clockwise) and a second direction (counterclockwise). The cord reel 40 is provided with a spiral groove on a circumference. Two third gears 41 are connected to opposite ends of the cord reel 40. In an embodiment, only one third gear 41 is connected to the cord reel 40. In the present embodiment, the cord reel 40 has a cone section and a straight section, wherein the cone section begins at the top end of the cord reel 40 and gradually narrows to the straight section, and the straight section has a constant diameter. In another embodiment, the cord reel 40 has the cone section only, and yet in another embodiment, the cone section has a concave surface. The cord reel 40 should keep that the top end is wider than the bottom end.

The driving module includes a first reel 42, a second reel 43, and a mainspring 44. The first and the second reels 42, 43 are vertically pivoted on the headrail 10 for free rotation. Both a top end and a bottom end of the first reel 42 are provided with a first gear 45, and a top end and a bottom end of the second reel 43 are provided with a second gear 46. The first gears 45 are meshed with the second gears 46, and the second gears 46 are meshed with the third gears 41, therefore the cord reel 40, the first reel 42, and the third reel 43 are linked to rotate together. In another embodiment, the first and the second reels 42, 43 each is provided with one gear only. Opposite ends of the mainspring 44 are connected to the first and the second reels 42, 43 respectively, therefore the mainspring 44 would be wound around the first and/or the second reels 42, 43 while the reels 42, 43 are rotating in different directions. While the mainspring 44 is being switched to be wound around the first or the second reels 42, 43, it will indirectly drive the cord reel 40 to rotate. In the present invention, while the mainspring 44 is wound around the first reel 42 (FIG. 3), the mainspring 44 will force the second reel 46 to rotate in the second direction (counterclockwise), and to rotate the cord reel 40 in the first direction (clockwise).

The auxiliary driving device includes a third reel 47, a fourth reel 48, and a mainspring 49. The third and the fourth reel 47, 48 are vertically pivoted on the headrail 10 while the fourth reel 48 is next to the first reel 42. Opposite ends of the mainspring 49 are connected to the third and the fourth reels 47, 48 respectively. The fourth reel 48 is provided with two fourth gears 50 to be meshed with the first gears 45 of the first reel 42, and the third reel 47 has no gear. The mainspring 49 would drive the fourth reel 48 to rotate to assist the mainspring 44 to rotate the second reel 43.

The wheel set 51 is fixed to the headrail 10, and has a shaft 51*a*. The car 52 is capable to reciprocate in a space between the wheel set 51 and the cord reel 40. The car 52 includes a body 52*a*, on which a shaft 52*b* and wheels 52*c* are provided. The shaft 52*b* of the car 52 is parallel to the shaft 51*a* of the wheel set 51, and both the shafts 51*a*, 52*b* are perpendicular to the moving direction of the car 52. The shafts 51*a*, 52*b* are provided with several grooves to receive the cords running around them. The wheels 52*c* are pivoted on the body 52*a* to touch and move along the headrail that is helpful for a smooth reciprocation of the car 52.

The connecting cord 53 has opposite ends fastened to the body 52*a* of the car 52 and the cord reel 40 respectively. When the cord reel 40 is rotating in the first direction (clockwise), it will move the car 52 toward the cord reel 40, and when the cord reel 40 is rotating in the second direction (counterclockwise), it will move the car 52 toward the wheel set 51.

The lifting cords 54 have ends fastened to the body 52*a* of the car 52, run around the shaft 51*a* of the wheel set 51 and the shaft 52*b* of the car 52 for several rounds, and then extend out of the headrail 10 and pass through the cellular shade 30 to be fastened to the bottom rail 20. While the bottom rail 20 is lifted or lowered, it will move the car 52 in different directions through the connecting cord 53 and the lifting cords 54.

The grooves on the shafts 51*a*, 52*b* makes the lifting cords 54 not twisting while the car 52 is moving. In the present embodiment, the lifting cords 54 run around the shafts 51*a*, 52*b* one time each that makes the bottom rail 20 moves twice the distance as far as the car 52 moves. In another embodiment, the bottom rail 20 moves triple the distance as far as the car 52 far as the car 52 moves while the lifting cords 54 run around the shafts 51*a*, 52*b* and 51*a* again. It is easy to understand that the moving distance of the bottom rail 20 could be designated by changing the rounds of the lifting cords 54 running around the shafts 51*a*, 52*b*. The number of the grooves on the shafts 51*a*, 52*b* can be varied according to the rounds of the lifting cords 54, such as 4 rounds, 5 rounds, 6 rounds, or more. The arrangement of shafts 51*a*, 52*b* helps receiving the lifting cords 54 in the limited space of the headrail 10.

Figure 4:
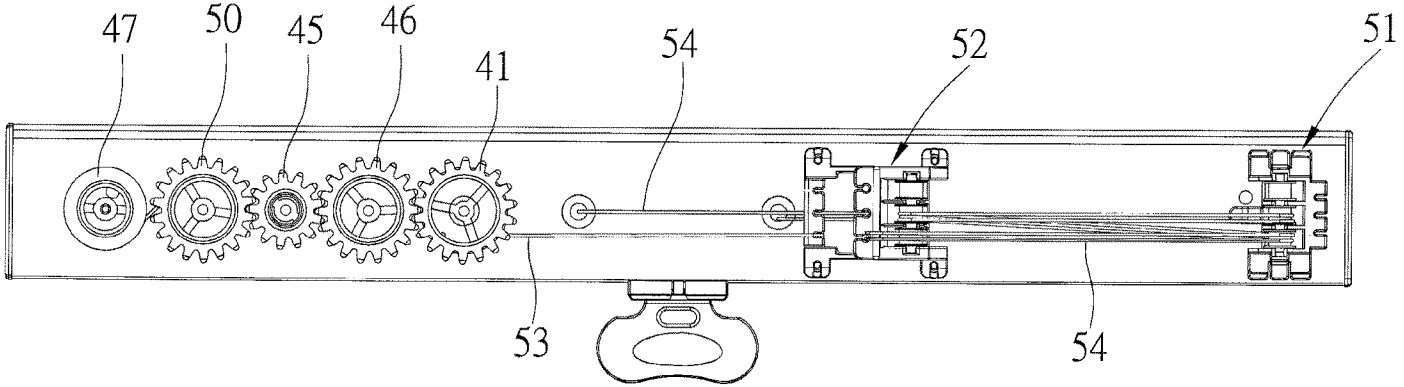
FIG. 4 is a top view of the lifting device of the preferred embodiment of the present invention, showing the car close to the cord reel.
Figure 5:
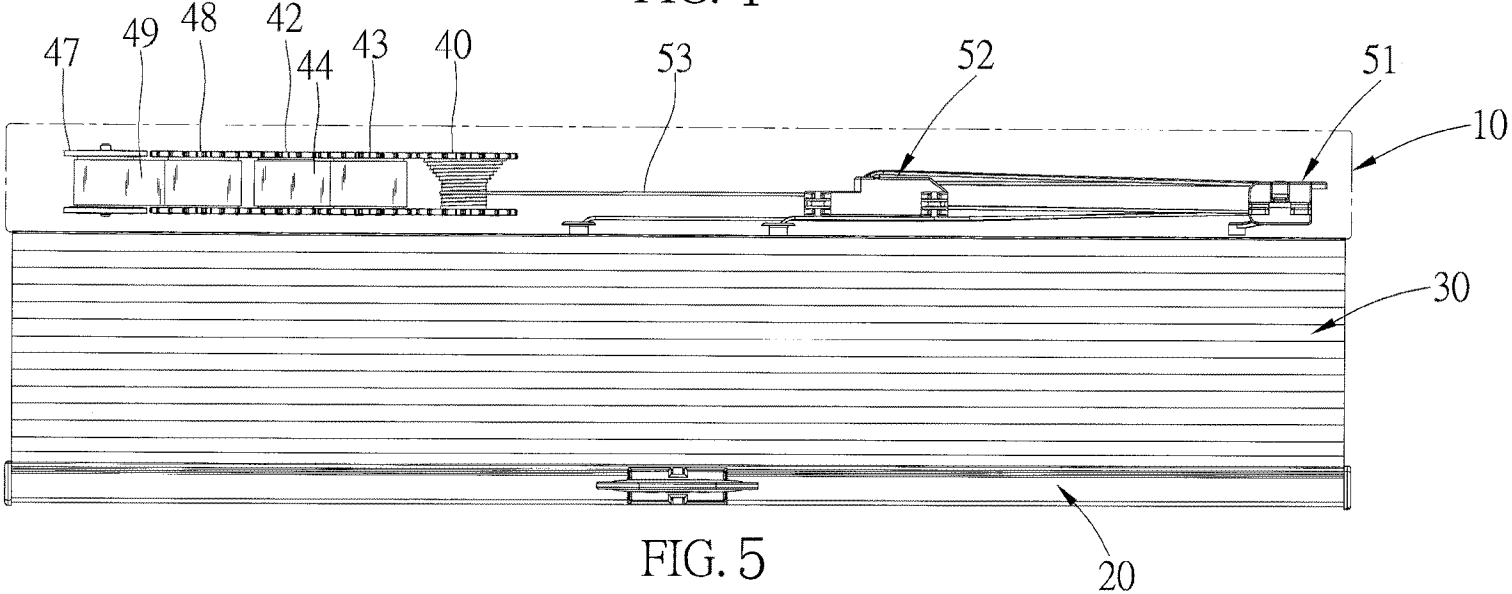
FIG. 5 is a front view of FIG. 4, showing the bottom rail being lifted.

As shown in FIG. 4 and FIG. 5, while someone moves the bottom rail 20 upwards to compress the cellular shade 30, the mainsprings 44 and 49 work at the same time to rotate the cord reel 40 in the first direction (clockwise), and therefore to wind the connecting cord 53 around the cord reel 40 from the top end to the bottom end. Since the diameter of the cone section of the cord reel 40 gradually decreases, the torque provided by the cord reel 40 would increase while the cord reel 40 is rotating. As a result, the force to pull the car 52 is increasing to sustain the increasing loading while the bottom rail 20 is being lifted. With the help of the mainsprings 44 and 49, the bottom rail 20 shall precisely stopped at any desired position. In another embodiment, it provides the driving module only (without the auxiliary driving device) for a small covering which has a light bottom rail and a light covering material. On the contrary, it can use multiple auxiliary driving modules in a large covering which has a heavy bottom rail and a heavy covering material.

Figure 6:
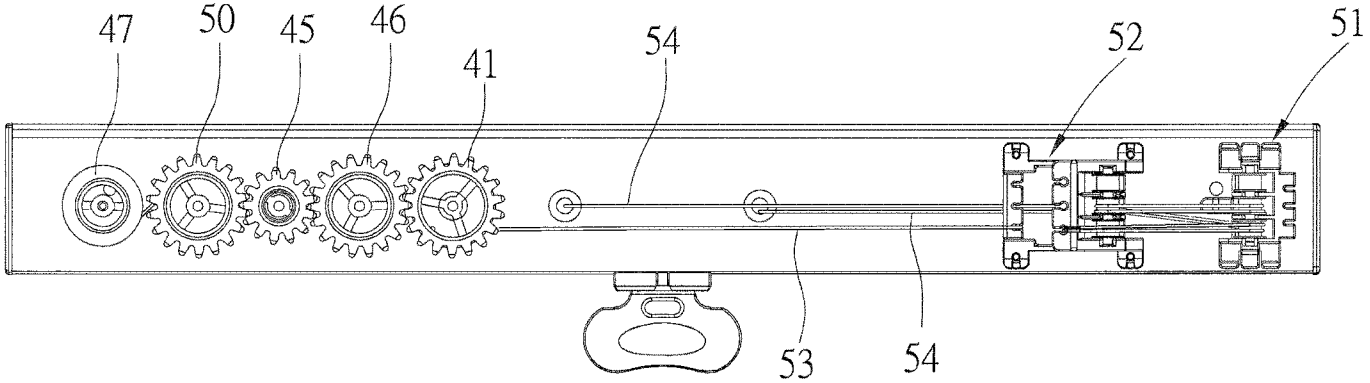
FIG. 6 is a top view of the lifting device of the preferred embodiment of the present invention, showing the car away from the cord reel.
Figure 7:
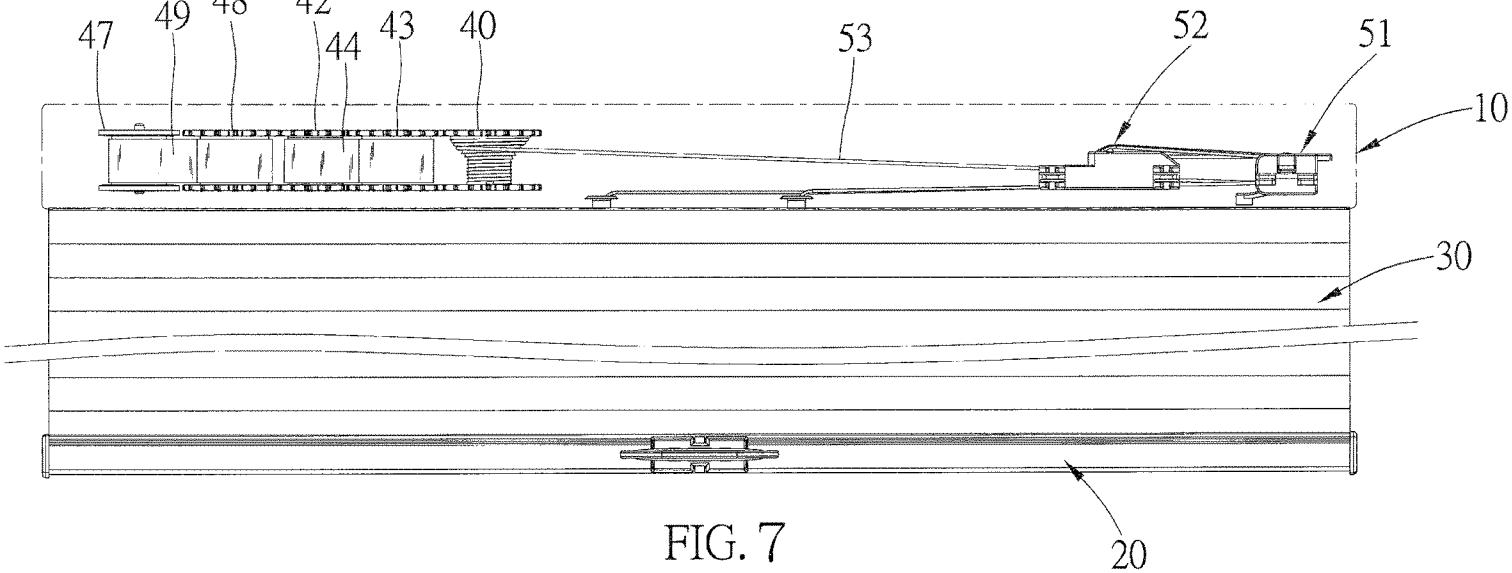
FIG. 7 is a front view of the preferred embodiment of the present invention, showing the bottom rail being lowered.

As shown in FIG. 6 and FIG. 7, while someone moves the bottom rail 20 downwards to extend the cellular shade 30, the car 52 is pulled by the lifting cords 54 to move away from the cord reel 40. It rotates the cord reel 40 in the second direction (counterclockwise), and therefore the first and the second reels 42, 43 are rotated in opposite directions, and the mainspring 44 is gradually wound around the second reel 43 from the first reel 42 until the bottom rail 20 stops. On the contrary, when the bottom rail 20 is being lifted, the mainsprings 44 and 49 and the cone section of the cord reel provide the driving torque to sustain the increasing loading that would make bottom rail 20 be lifted easier and precisely stopped at any position.

It must be pointed out that the embodiments described above are only some preferred embodiments of the present invention. All equivalent structures which employ the concepts disclosed in this specification and the appended claims should fall within the scope of the present invention.

What is claimed is:

1. A lifting device for a cordless covering, wherein the cordless covering comprises a headrail, a bottom rail and a covering material between the headrail and the bottom rail; the covering material is a cellular shade; the lifting device comprising:

a cord reel, wherein the cord reel comprises a cone section at a first end thereof and a straight section connected to the cone section; a diameter of the cone section decreases from the first end thereof to a second end thereof; the cord reel is pivotally mounted on the headrail to be rotated in a first direction or in a second direction opposite to the first direction;

a car, wherein the car is movably received in the headrail to be moved toward or away from the cord reel;

a driving module, wherein the driving module is received in the headrail to drive the cord reel to rotate in the first direction;

a connecting cord which comprises opposite ends connected to the car and the cord reel, wherein the connecting cord is reeled in the cord reel when the cord reel rotates in the first direction; the connecting cord is reeled out from the cord reel when the cord reel rotates in the second direction;

a lifting cord, wherein the lifting cord comprises an end running around the car and an opposite end extending out of the headrail to be fastened to the bottom rail, whereby the car moves away from the cord reel to drive the cord reel to rotate in the second direction while the bottom rail is moved away from the headrail; and a wheel set, wherein the wheel set is received in the headrail; the wheel set comprises a shaft for the lifting cord to run around;

wherein the car comprises a shaft for the lifting cord to run around;

the shaft of the wheel set is perpendicular to a moving direction of the car; the shaft of the wheel set is parallel to the shaft of the car;

an extending direction of the opposite end of the lifting cord is both perpendicular to the shaft of the wheel set and the moving direction of the car.

2. The lifting device of claim 1, wherein the driving module comprises a first reel, a second reel and a mainspring;

the first reel comprises a first gear;

the second reel comprises a second gear to be meshed with the first gear;

the cord reel further comprises a third gear to be meshed with the second gear; and the mainspring comprises opposite ends connected to the first reel and the second reel respectively, whereby the mainspring is wound around the first reel or the second reel when the first reel and the second reel rotate in the first direction or in the second direction.

3. The lifting device of claim 1, wherein the ends of the lifting cord are fastened to the car and the bottom rail respectively.

4. The lifting device of claim 1, wherein the ends of the lifting cord are fastened to the wheel set and the bottom rail respectively.

* * * * *